US005460775A

United States Patent [19]

Hayashi et al.

[11] Patent Number: 5,460,775

[45] Date of Patent: Oct. 24, 1995

[54] NITROGEN-COMBINED ALUMINUM SINTERED ALLOYS AND METHOD OF PRODUCING THE SAME

[75] Inventors: Tetsuya Hayashi; Yoshinobu Takeda, both of Itami, Japan

[73] Assignee: Sumitomo Electric Industries, Ltd., Osaka, Japan

[21] Appl. No.: 84,947

[22] Filed: Jul. 2, 1993

[30] Foreign Application Priority Data

Jul. 2, 1992 [JP] Japan ..... 4-200226

[51] Int. Cl.[6] ..... B22F 1/00; B22F 3/16

[52] U.S. Cl. ..... 419/30; 419/10; 419/12; 419/13; 419/14; 419/19; 419/23; 419/33; 419/38; 419/44; 419/57

[58] Field of Search ..... 419/10, 12, 13, 419/14, 19, 23, 33, 30, 38, 44, 57

[56] References Cited

U.S. PATENT DOCUMENTS

| | | | |
|---|---|---|---|
| 4,015,947 | 4/1977 | Daver | 75/201 |
| 4,292,079 | 9/1981 | Pickens et al. | 75/232 |
| 4,333,775 | 6/1982 | Mahrus | 148/11.5 Q |
| 4,460,541 | 7/1984 | Singleton et al. | 419/42 |
| 4,532,106 | 7/1985 | Pickens | 420/528 |
| 4,534,937 | 8/1985 | Meunier et al. | 419/42 |
| 4,722,754 | 2/1988 | Ghosh et al. | 148/11.5 A |
| 4,726,843 | 2/1988 | Couper | 75/249 |
| 4,737,339 | 4/1988 | Couper | 419/23 |
| 4,755,221 | 7/1988 | Paliwal et al. | 75/244 |
| 4,770,848 | 9/1988 | Ghosh et al. | 419/28 |

FOREIGN PATENT DOCUMENTS

| | | |
|---|---|---|
| 0147769 | 7/1985 | European Pat. Off. . |
| 2038523 | 1/1971 | France . |
| WO92/08560 | 5/1992 | WIPO . |

OTHER PUBLICATIONS

Chemical Abstracts, vol. 108, No. 22, Columbus, Ohio, US; abstract No. 191223, Hirano, Tadao et al. 'Pressing of sintered aluminum alloy' *abstract* & JP–A–62 287 026 (Showa Denko K.K.) 12 Dec. 1987.

Patent Abstracts of Japan, vol. 12, No. 338 (C–527) 12 Sep. 1988 & JP–A–63 096 227 (Sumitomo Light Metal Ind Ltd) 27 Apr. 1988 *abstract*.

Chemical Abstracts, vol. 86, No. 8, Columbus, Ohio, US; abstract No. 46482, Gorynin, I. V. et al. 'Aluminum alloy' *abstract* & SU522 251, 25 Jul. 1976.

Hirschhorn, Joel S., "Intro To Powder Metallurgy", American Powder Met. Institute, pp. 96–99, 216–230; 1969.

Jones, W. D., "Fundamental Principles of Powder Metallurgy", Edward Arnold Pub., 1960, pp. 260–273, 583–594.

*Primary Examiner*—Donald P. Walsh
*Assistant Examiner*—Daniel J. Jenkins
*Attorney, Agent, or Firm*—Wenderoth, Lind & Ponack

[57] ABSTRACT

The invention provides aluminum sintered alloys with high dimensional accuracy and high density which are superior in mechanical and physical characteristics as well as wear resistance, and a method of producing such alloys not by plastic working but by atmospheric sintering with high economy. Rapidly solidified aluminum alloy powder resulting from solidifying aluminum alloy molten metal containing 0.4 to 4.0% by weight of Mg at a solidification rate of $10^{2}$° C./sec or more is press molded in the cold, after annealing in the temperature range of 250 to 450° C. if necessary, and then the molded product is sintered by generating nitrogen compounds on the powder surface at atmospheric pressure with a nitrogen partial pressure of 0.8 atm or more and a steam partial pressure of 0.01 atm or less in which a reducing gas component has been added as a nitrogen-combining acceleration gas component by 0.01 atm or more. Thus, a nitrogen-combined aluminum sintered alloy containing 0.4 to 4.0% by weight and 0.2 to 4.0% by weight of nitrogen is obtained.

10 Claims, 6 Drawing Sheets

NITROGEN-COMBINED ALUMINUM SINTERED ALLOYS AND METHOD OF PRODUCING THE SAME

BACKGROUND OF THE INVENTION

1. Field of the Invention

The present invention relates to aluminum sintered alloys with high accuracy and high density which are excellent in mechanical and physical characteristics as well as superior in wear resistance. The invention also relates to a method of economically producing such alloys not by plastic working but by atmospheric sintering.

The object of the present invention is to provide aluminum alloys satisfying such characteristic requirements as are demanded for mechanical structure parts, by atmospheric sintering that allows the aluminum alloys to be formed into various shapes at a high degree of freedom. Examples of its industrial applications include compressor parts such as side plates, housings, cylinders, casings, vanes, shoes, and rotors, automobile parts such as timing pulleys, oil pump rotors, and bushings, and business machine components such as rollers, gears, and bearings.

2. Description of the Prior Art

Aluminum powder or aluminum alloy powder generally has a hard oxide film, which is impossible to reduce existing on its surface. Therefore, in producing aluminum sintered alloys, it is necessary to break up the oxide film to form metallic contact portions among the powder particles, and thus allow the metal atoms to be diffused. Unless powder particles are strongly coupled together by diffusing metal atoms, strong sintered products could not be obtained. Conventionally, two methods have been available for this purpose.

(1) Mixing a sintering aid

This method is carried out in the following way. After a powder having an alloy component which generates an eutectic liquid phase on the side lower than the melting point of aluminum or aluminum alloy composition is added to a material as a sintering aid, compression molding is effected. An eutectic liquid phase is generated from metallic contact portions between the sintering aid formed in the molded product during the temperature elevation process of the sintering progression and aluminum powder or aluminum alloy powder, thereby allowing the metallic contact portions to be expanded, whereby the sintering is made to progress.

Japanese Patent Laid-Open Publication SHO 47-34006 has proposed a method of producing aluminum (Al) sintered alloys which comprises sintering a molded product, in which aluminum powder is mixed with Cu or Cu-Sn powder, under a non-oxidized or reducing atmosphere.

Japanese Patent Publication SHO 51-13444 has proposed a method in which a powder of Mg, Zn, or the like is added as a sintering aid.

Japanese Patent Laid-Open Publication SHO 50-96409 has proposed a method in which Mg powder or a Cu-Mg base alloy powder is added as a sintering aid.

Japanese Patent Publications SHO 61-17895, SHO 61-54855, SHO 61-6243, and SHO 62-6626 have disclosed methods in which Cu, Mg, Si, Zn, or other element powder or alloy powder is mixed as a sintering aid.

The following description is made upon the process of producing sintered alloys containing Si.

Japanese Patent Publication SHO 53-118209 has proposed a method of producing sintered products containing 20 to 50% by weight of Si in total, wherein an Al-Si binary alloy powder having a composition in the vicinity of Al-11.7Si, which is an eutectic composition, is mixed with a metal Si powder and, as required, an alloy powder as sintering aids.

Japanese Patent Publication SHO 60-38442 has proposed a method of producing low-Si-content low-density sintered products with 2.1% or less by weight of Si, wherein Al powder or Al-Si alloy powder is mixed with Al-Cu-Mg, Al-Cu-Mg-Si, or Cu-Mg-Si alloy powder as a sintering aid at a compounding ratio of less than 30% by weight, and the mixture, after compression molding, is sintered in a temperature range of 550 to 650° C.

Further, Japanese Patent Publication SHO 59-37339 has proposed a method of producing high-Si-content sintered products, wherein a Cu, Mg, or Si component is added and blended as a single-component powder or alloy powder. This publication also describes an example in which an Al-25Si-2Cu-0.5Mg alloy powder is sintered in a high-purity nitrogen gas (dew point: −70° C. or lower) atmosphere at 555° C. for 60 min, in which case the resulting sintered product showed a tensile strength of only 9.2 kg/mm$^2$.

(2) Adding plastic working

This method is one newly developed in recent years as a new powder metallurgical technique, in which powder particles are coupled together by plastic working. More specifically, the powder is plastically deformed by applying intense plastic working to the powder so that the oxide film on the powder surface is broken up and segmented, and that adjoining powder particles are coupled together, thus generating metallic contact portions. The oxide film is broken up by physical means, eliminating the need of any sintering aid. The plastic working method may be the hot pressing, powder forging, powder extruding, powder rolling, or the like. The method by plastic working allows processing in relatively low temperature ranges, so that high-density alloys retaining to some extent the effect of the rapid solidification can be obtained.

Japanese Patent Laid-Open Publication SHO 60-121203 has proposed a method of extruding aluminum alloy powders at 250 to 550° C. with an extruding ratio of 4:1 to 15:1. In this case, since strong shear force is applied to extrude an aluminum alloy powder, the oxide film is broken up, so that internal metals of adjoining powder particles are coupled together.

Japanese Patent Laid-Open Publication SHO 61-136602 has proposed a method of hot pressing aluminum alloy powders after hot molding. The hot pressing acts to break up the oxide film on the powder surface, bringing the internal metals into contact with one another, with the metal atoms diffused.

Any of these methods, (1) mixing a sintering aid, and (2) adding plastic working, makes it possible to break up the oxide film and bring metals into contact with one another, whereby metal atoms can be diffused through the contact portions.

However, the above-described conventional methods of producing aluminum sintered alloys have the following drawbacks.

(1) Drawbacks of the method using a sintering aid

In the method in which a powder mixed with a sintering aid that generates an eutectic liquid phase is sintered after compression molding, there is a problem that the places where the eutectic liquid phase is generated are maldistributed, due to the fact that the sintering aid distribution is performed by the mixing method. This leads to a great possibility that density spots or segregation will take place in terms of composition, resulting in poor homogeneity in the powder's sintered state. Since coarse pores and orifices tend to remain, it is difficult to obtain high-accuracy and high-density sintered products.

Any sintered product obtained by this method would involve coarsened fine deposits, which are to be generated by rapid solidification. Thus, it would be greatly inferior in mechanical characteristics to those obtained through plastic working.

(2) Drawbacks of the method by plastic working

Sintering by plastic working advantageously allows processing in relatively low temperature ranges and offers high-density materials. However, being required to apply high pressures in processing, this method involves expensive equipment and high-production cost. Moreover, it is subject to configurational restrictions, making it difficult to produce near net shaped materials, with lower material yield.

SUMMARY OF THE INVENTION

The conventional method employing sintering aids, in which a liquid phase is generated by an eutectic reaction, is accompanied by maldistribution of the eutectic liquid phase, density spots, segregation, and the like, so that high-accuracy, high-quality sintered alloys cannot be obtained. This is due to the fact that an eutectic liquid phase is generated at interfaces between Al powder or Al alloy powder and sintering aid, the oxide film is segmented, and sintering is carried out. Disordered distribution of the sintering aid causes disordered distribution of the eutectic liquid phase, permitting the occurrence of density spots, segregation, and the like. Hence, the present invention has as its primary object to producing Al sintered alloys without using any sintering aid.

Further, use of plastic working would involve increased equipment expenditure and production cost, as stated above. Thus, another object of the invention is to produce Al sintered alloys without using plastic working.

Nitrogen-combined aluminum sintered alloys of the present invention are characterized by containing 0.4 to 4.0% by weight of Mg and 0.2 to 4.0% by weight of nitrogen. The method of producing the same of the invention is characterized in that rapidly solidified aluminum alloy powder resulting from solidifying aluminum alloy molten metal containing 0.4 to 4.0% by weight of Mg at a solidification rate of $10^{2\circ}$ C./sec or more is molded by cold pressing, after annealing in the temperature range of 250 to 450° C. if necessary, and then the molded product is sintered by generating nitrogen compounds on the powder surface at atmospheric pressure with a nitrogen partial pressure of 0.8 atm or more and a steam partial pressure of 0.01 atm or less in which a reducing gas component has been added as a nitrogen-combining acceleration gas component of 0.01 atm or more.

In brief, aluminum sintered alloys of the present invention are sintered at lower than the melting points of powder compositions in high accuracy at atmospheric pressure without plastic working, which are accomplished by molding an aluminum alloy powder containing Mg and accelerating the sintering process through the nitrogen combining reaction of the molded product with nitrogen components contained in the sintering gas atmosphere.

The atmospheric pressure herein refers to such ordinary pressure that the pressure applied to the molded product in sintering is derived from the atmospheric gas, meaning that no extraordinary high pressure such as applied in the foregoing plastic working is used.

Simultaneously effecting the reform of powder surface by addition of Mg and the combining reaction with atmospheric nitrogen has made it possible to accelerate the sintering phenomenon of aluminum alloy powders, which has been considered difficult to implement up to now. However, since physical and mechanical characteristics of a sintered alloy depend largely upon the density of the sintered product, it becomes a second point how compact a sintered product can be obtained. As the method for this compaction, the following two methods have been found which use rapidly solidified alloy powder.

(1) Method involving densification in the molding process

To obtain high-accuracy, high-density sintered products, it is effective to densify the material in its molding.

The molding method may be pressing, cold isostatic pressing, or the like. In the case of pressing, some powdered lubricant is mixed or some lubricant is applied directly onto the metal mold, in order to prevent the occurrence of seizure with the metal mold or to improve the fluidity of the powder. Generally, elevated molding pressure will allow higher density. However, it involves higher load to the die, which leads not only to limited molding shapes but to shortened service life of the die as well. Thus, such high pressure moldings as exceeds 8 to 10 ton/cm$^2$ are not adopted in ordinary cases. Accordingly, to obtain high molding density, it is necessary to use a material powder superior in compactibility and moldability.

The molding density, although affected also by the shape of the powder and the like, depends largely upon the hardness of the powder. To accomplish high densification in molding, it is important for the powder matrix to be of the soft type.

From the standpoint of hardness of the molding powder, the matrix composition of the molding powder desirably consists of a lower alloy component. However, age-deposition hardening type elements are added in view of the need for ensuring practical strengths, while the powder is subjected to overaging treatment so as to be softened for the purpose of giving such a composition that characteristic enhancement can be achieved through heat treatment.

To ensure the proper physical and mechanical characteristics or wear resistance, it is effective to disperse the hard particles into a matrix. The hard particles are desirably ceramics or other similar hard particles which will not dissolve in a matrix, or Si crystals of small solubility, so as not to deteriorate the compactibility of the powder. Powdering the molten metal that results from dispersing the hard particles or dissolving Si will allow the hard particles or Si crystals to be dispersed finely and homogeneously by rapid solidification. In this case, also, even if a large amount of particles and Si are contained, the particles and Si crystals can be suppressed from being bridged, which in turn serves to reduce the effect upon high densification.

Furthermore, the sintered product can be increased in strength by partly mixing soft powder to thereby improve the moldability and compactibility.

(2) Method involving high densification in sintering process

For applications in which heat resistance and heat stability or high mechanical characteristics are desired, there arises a need for a matrix having high alloy content in which a hard, stable intermetallic compound has been dispersed. According to the rapid solidification method, it is possible to contain Fe, Ni, and Mn, which could be added in only small amounts by the ingot method, or Ti, Cr, V, Mo, Zr, and the like, with a view to hardening the base and improving the heat resistance. However, although the moldability and compactibility can be improved to some extent by powder annealing, the matrix hardness is so high that the sintered product can hardly be high densified only by molding, necessitating some producing method for facilitating the compaction in the sintering process. In general, if a liquid phase is generated in the sintering process, the compaction can be achieved, whereas any excessive amount of liquid phase or disordered distribution of the liquid phase generated would result in deteriorated dimensional accuracy. Moreover, a great amount of liquid phase, if generated, would incur a coarsened structure of the product.

A liquid phase sintering method available is one in which a liquid phase is generated by a conventional eutectic reaction, and then sintered. This method may encounter difficulties due to the fact that the eutectic liquid phase is generated at the interfaces between Al powder or Al alloy powder and sintering aid to implement the sintering process. This being the case, the difficulties inherent in the sintering method which involves the addition of a sintering aid are to be solved by a method which involves no addition or mixing of sintering aids to accomplish the sintering. More specifically, it is arranged that a small amount of liquid phase is generated homogeneously within the individual powder particles, thereby distributing the liquid phase with high density and homogeneity within the molded product, so that uniform shrinkage in the sintering process can be realized and high dimensional accuracy can be obtained.

According to the present invention, in order to generate a liquid phase within the powder, first the molten metal of a composition containing Cu and Mg at the same time is rapidly solidified in its powdering, thereby producing a powder in which such a semi-stable phase is formed as will allow a liquid phase to be generated below the melting points of the required alloy composition. The semi-stable liquid phase that has been generated in the course of the heating process of the powder acts to segment the oxide film on the powder surface, allowing the metallic contact portions to be expanded along with progress of sintering. Since the phase's state within the molded product is of homogeneity, even a small amount of liquid phase could allow a uniform shrinkage in a short time, in which case high-accuracy, high-density sintered products with extremely small composition spots and segregation can be produced.

Also in this case, softening the powder by powder annealing within such a range as will not impair the generation of the liquid phase allows high-density molded products to be obtained under low pressures, which is effective to implement high densification of the sintered products. Further, partly mixing a soft powder allows the molding density to be increased with increased sinterability.

This alloy contains Cu and Mg, which makes it possible to improve the strength through heat treatment.

In the method involving high densification in the sintering process, the mechanical and physical characteristics can be further improved, if required, by dispersing the fine particles. Although mixing is a simple method to add dispersed particles, it encounters a problem of coalescence of particles so that the effect of improvement in mechanical characteristics cannot be derived. Thus, in the present invention, it is devised that dispersed particles are refined and dispersed with uniformity and high density to thereby improve mechanical characteristics to a large extent, by using a method of powdering the molten metal containing dispersed particles in the process of producing powder, or a method of mechanically crushing and re-coalescing mixed powder.

Sintered materials obtained by the method of the present invention can afford near net shaped materials, which is a merit of the conventional powder metallurgical technique. Also, the sintered materials, if provided with an adequate amount of pores distributed therein, can be processed with high accuracy by sizing or coining. In consequence, the method of the invention can be said to be a method of economically producing high-accuracy sintered products with a high degree of freedom of shaping.

In the present invention, composition and production conditions are limited. What are meant by these limitations are explained below.

Amount of Mg to be added

The amount of Mg to be added is important in the present invention. Mg acts to reduce the oxide film formed on the powder surface in the atomizing in sintering, and moreover to facilitate the reaction with nitrogen atmosphere to expand the metallic contact portions, thereby accelerating the sintering phenomenon. If Mg is present together with Si or Cu, it becomes possible to improve mechanical characteristics by effecting solution treatment and aging treatment. If the Mg addition amount is below 0.4% by weight, such effects as described above will be insufficient. Conversely, if it exceeds 4.0% by weight, the dimensional accuracy of the sintered product will be deteriorated, or heat resistance and toughness of the base will lower. Therefore, the desirable content of Mg is 0.4 to 4.0% by weight.

Content of nitrogen

To contain nitrogen is particularly important in the present invention. Nitrogen is present as a nitrogen compound that is generated on the powder surface in sintering from reaction of atmospheric nitrogen and an aluminum alloy, and it facilitates the sintering phenomenon. Further, nitrogen compounds are such hard compounds as to provide increased wear resistance. If the content of nitrogen is lower than 0.2% by weight, such effects as described above will be insufficient. Conversely, if an amount of nitrogen compound exceeding 4.0% by weight is present, the toughness of the sintered product will lower. Therefore, the desirable nitrogen content is 0.2 to 4.0% by weight.

Form of nitrogen compound

The combining reaction of raw powder and nitrogen occurs on the powder surface, while the nitrogen compound is generated on the prior powder interface or prior powder surface, contributing to the coupling between powder particles and facilitating the sintering. Also, unlike the case where the nitrogen compound is dispersed as particles, the nitrogen compound of the present invention is generated by reaction and therefore superior in cohesion and extremely densely dispersed, so that it contributes to much increase in wear resistance and hardness. However, a nitrogen compound layer, if exceeding 10 μm, would be a cause of decrease in toughness, its thickness being preferably not more than 10 μm. Under common sintering conditions, the thickness of the nitrogen compound should be 0.1 to 5 μm.

Solidification rate of atomized powder

In the present invention, the solidification rate of the aluminum alloy molten metal in producing atomized powder is of importance. In the method of liquid-phase sintering in which a semi-stable phase is liquefied in sintering, it is essential that a semi-stable phase has been generated in the material powder, the semi-stable phase being generated by rapid solidification. If the solidification rate is less than $10^{2\circ}$ C./sec, the semi-stable phase will not be generated, or otherwise only such a small amount of it will be generated that the sintering will not progress adequately.

Further, in the method in which high densification is involved in molding, it is effective to accumulate diffusion energy during sintering by rapid solidification, in order to facilitate the sintering phenomenon. If the solidification rate is less than $10^{2\circ}$ C./sec, such effects as described above will be insufficient. Therefore, the solidification rate is desirably not less than $10^{2\circ}$ C./sec.

Particle size of powder

When powder is produced by an atomizing method, the solidification rate differs depending on the particle size of powder. The frequency of metallic contact portions among powder particles and the surface area reacting with nitrogen are affected also by the solidification rate. If the maximum particle size of powder exceeds 350 μm, or if the mean particle size exceeds 75 μm, the sinterability will lower. Accordingly, the maximum particle size is desirably not more than 350 μm and the mean particle size, not more than 75 μm.

Granulation of powder

Too small particle size of atomized powder result in poor fluidity or chargeability of the powder into the die. Thus, by mechanically granulating the atomized powder, the sintered product can be provided with higher accuracy as a powder which is superior in fluidity and chargeability in such a state that the degree of rapid solidification and physical properties of the powder are maintained appropriately.

Annealing of powder

If there is a need of improving the moldability and compactibility, it is proper to subject the powder to an annealing treatment. Atomized powder is rapidly solidified, endowed with a high hardness, so that it can be improved in moldability and compactibility by being softened when annealed at temperatures higher than the aging treatment temperature of the alloy. The annealing will take a long time to soften the powder by overaging at temperatures lower than 250° C. In contrast, at temperatures over 450° C., powder particles are sintered among them, or sintering energy accumulated through rapid solidification is consumed, or the semi-stable phase is stabilized, disadvantageously. Thus, the annealing is carried out at temperatures of 250 to 450° C. In this range of temperatures, if the powder is-elevated in temperature to the annealing temperature at a normal heating rate, the pure-component powder will be softened. To implement annealing with higher homogeneity, the annealing is required to be held for at least 30 to 60 minutes.

Cold pressing

Hot molding may also be applied for higher-density molding. In the present invention, however, cold pressing is appropriate in terms of the economy and its effects.

Lubricant

In the pressing die, it is the usual case to mix a powdered lubricant to the material powder for the purpose of prevention of seizure with the metal mold, or to apply a lubricant directly onto the metal mold. The lubricant to be added is required to have such tendencies that it will gasify at temperatures below the sintering temperature and will not impair the sinterability.

Using low-hardness powder

Mixing a powder lower in hardness than a material powder allows improvement in the compactibility. The Mg content of a low-hardness powder to be added is set to 0.4 to 4.0% by weight from the reason described before. In order to ensure the softness of the powder, the Al component needs to be over 85% by weight. Other components may be contained if their hardness is lower than that of the main-material powder. The mixing amount of the low-hardness powder is set to 30% by weight or less. If it exceeds this level, there will arise portions where the low-hardness powder particles added are sintered among them, causing the effect of strength improvement to be reduced. For this reason, the mixing amount should be 30% by weight.

Relative density of molded product

In a method in which high densification is involved in molding, if the relative density of the molded product is less than 90%, the resulting strength of the sintered product will be a low one. To avoid this, it is desirable to set the relative density to 90% or more. The molding density should be as high as possible with a view to obtaining sintered products superior in strength and toughness.

Further, in the liquid-phase method in which high densification is involved in sintering, although the powder is too hard to obtain a high molding density, the strength of molded products results in a low one with the relative density of molded product lower than 70%. Therefore, the relative density should be not less than 70%.

Sintering atmosphere

In the present invention, the sintering atmosphere is particularly important. In order that a nitrogen compound is generated on the powder surface in sintering to accelerate the sintering phenomenon and improve the wear resistance of the sintering material, there is a need of forming an atmosphere composed primarily of nitrogen gas. For this purpose, the nitrogen partial pressure is required to be 0.8 atm or more. Moreover, at the same time, a reducing gaseous component needs to be added to 0.01 atm or more as a gaseous component that serves to accelerate the nitrogen combination on the powder surface. Although pressurization will facilitate the sintering to some extent, the atmospheric pressure may be sufficient to obtain the improved product of the present invention in terms of economy and equipment involved. Also, higher steam partial pressure in the atmosphere would cause the Mg component to react with steam component, the Mg component serving to reduce the powder surface oxide film during sintering and to accelerate the reaction with the atmospheric nitrogen, thus impairing the effect of the addition of Mg component. Furthermore, steam acts to decompose the nitrogen compound formed on the powder surface. Also to make the moisture adsorbed on the powder surface evaporate and decompose during the process of temperature elevation up to the sintering temperature, the steam partial pressure should be controlled lower level. Therefore, it is of importance to suppress the steam partial pressure to 0.01 atm or less.

Sintering temperature

Molded products are heated to proper temperature so as to be sintered. The sintering temperature differs between (1) alloy systems for production methods in which high densification is involved in molding, and (2) alloy systems for production methods in which high densification is involved in sintering. In the case of (1), the sintering temperature should desirably range from 500 to 570° C. At temperatures below 500° C., the amount of reaction with atmospheric nitrogen would result in a poor one, so that the sintering phenomenon by solid state diffusion will not progress to appropriate extent. Conversely, if the temperature exceeds 570° C., it approaches the eutectic point of Al-Si, 578° C., so that the alloy is softened and deformed with deteriorated dimensional accuracy of the sintered product, resulting in a coarsened structure. In order that the sintering is made to appropriately progress with ensured accuracy to thereby suppress the structure from being coarsened, the sintering temperature should be set to 500 to 570° C. For stricter accuracy, it is desirably 520 to 550° C. On the other hand, in the case of (2), the sintering temperature is set higher than the liquid-phase generation temperature Tc of the semi-stable phase obtained through rapid solidification, and lower than the melting point Tm of the powder. Of course, the liquid-phase generation temperature Tc of the semi-stable phase and the melting point Tm differs depending on the alloy composition of the powder. The alloy systems of the present invention have the liquid-phase generation temperature of semi-stable phase in the vicinity of 500° C., and the melting point of powder in the vicinity of 580° C.

Sintering time

Molded products are heated for a proper time in the range of sintering temperature so as to be sintered. A sintering time of 20 to 30 minutes allows the sintering to progress. However, to ensure the uniformity of sintering and higher strength, it is actually desirable to effect the heating for 1 to 4 hours. The amount of reaction with the atmospheric nitrogen increases with increasing sintering time, while the sintering phenomenon progresses. During this process, the sintered product is further compacted along with changes in the form and size of the deposits which are effective to improvement in wear resistance. Therefore, the sintering time should be selected depending on the characteristics and dimensional accuracy required. Also, in a method in which high densification is involved in sintering, the rate of progresses of sintering is fast due to occurrence of the liquid phase in sintering. Thus, quite a shorter sintering time will do for the method, compared with methods in which high densification is involved in molding.

Dimensional changes in sintering

In alloy systems taking a method in which high densification is involved in molding, it is possible to render high accuracy sintering by suppressing dimensional changes in sintering. The dimensional change rate for ensuring the dimensional accuracy is to be within 1.5%. For stricter accuracy, it should desirably be within 1%.

Relative density of sintered product

Young's modulus and mechanical characteristics of sintered products become more superior as the relative density of the sintered product becomes higher. To ensure a tensile strength of 25 kg/mm$^2$ for sintered alloy systems with which high densification is involved in molding, or a tensile strength of 30 kg/mm$^2$ for those with which high densification is involved in sintering, the relative density of the sintered product needs to be over 90%. For stricter mechanical characteristics and the like, it is also possible to produce sintered products with relative density of 97% or more. Further, if the relative density is approximately 94 to 96%, it becomes possible to accomplish successful sizing and coining, offering high-accuracy products. Yet further, oil impregnation to pores in the sintered product, if implemented, allows the product to have a lubricity. For the sintered product to have such an effect, the upper limit of the relative density of the sintered product is set to 99%.

Alloy composition when high densification is involved in molding

A requirement for the material powder in the method in which high densification is involved in molding is that the matrix prior to molding is of soft type. Accordingly, alloy components are necessarily limited as follows.

Mg component, being an indispensable component for the present invention, will not substantially impair the moldability and compactibility of the powder in the range of 0.4 to 4.0% by weight, as described before, if the annealing treatment is performed. However, when Cu, Mn, Fe, Ni, or the like are contained in order to improve wear resistance or heat resistance by increasing the strength and hardness of the matrix, a total amount of addition of them over 2.0% by weight would cause the compactibility in molding to be deteriorated, thus the total amount of them being limited up to 2% by weight. Further, as an added element that can serve to improve the material characteristics without impairing the moldability and compactibility, Si component has been found which has a small amount of solid solution into the matrix, exhibiting the particle diffused type structure. Addition of Si exerts effects on reduction in coefficient of thermal expansion, increase in rigidity, improvement in wear resistance, and the like. Since these effects are still less with the Si addition amount below 4.0% by weight, the lower limit of the addition is set to 4.0% by weight in the present invention. If the Si addition amount exceeds 40.0% by weight, adverse effects upon the moldability and compactibility become no longer negligible, and moreover Si crystal diameter in the sintered product increases such that its toughness will be deteriorated and so is its grindability. Thus, the upper limit for the addition is set to 40.0% by weight.

The alloy systems of the invention, containing Si and Mg, can be heat treated.

Alloy composition when high densification is involved in sintering

To alloy compositions for the methods in which high densification is involved in sintering by liquefying the semi-stable phase, addition of Cu needed to form the semi-stable phase is indispensable. With an insufficient amount of Cu added, it is likely that no semi-stable phase will be generated or that even if it is generated, there cannot be obtained a liquid-phase amount needed for compaction. If the amount of Cu added is too much, the resulting liquid-phase amount will be too much, deteriorating the dimensional accuracy. Accordingly, the amount of Cu added to generate the semi-stable phase to a necessary amount is 1.0 to 8.0% by weight. The present system alloy contains Mg also, making it possible to render age-hardening heat treatment.

In sintering methods in which compaction is performed by liquid-phase sintering, there is only a small necessity of high densification in molding, in which case hard powders superior in wear resistance and heat resistance can be used. Cu is an essential component to generate the semi-stable phase and, besides, has a role to harden the matrix. Further, available as components having good effects for characteristic improvement are transition elements such as Fe, Ni, and Mn. Adding such transition elements as Fe, Ni, and Mn will produce effects upon reduction in coefficient of thermal expansion, increase in rigidity, improvement in wear resistance, and the like. Conventional forging methods would allow these transition elements to be added in only a small amount. The rapid solidification used in the present invention allows the transition elements to be added at high concentrations, so that hard, fine crystallized products and deposits are generated through rapid solidification, greatly improving the seizure resistance and strength. Moreover, the resulting crystallized products and deposits rather exhibit thermal stability, effectiveness for improving the heat resistance, and a small degree of coarsening even in the sintering temperature range. The total content of those elements (Ni+Fe+Mn) below 5.0% by weight would offer the foregoing effects, thus desirably over 5.0% by weight. Conversely, the total content of (Ni+Fe+Mn) over 30.0% by weight would result in too high a melting temperature, making it difficult to melt the alloy and moreover causing enlarged deposits within the sintered product, which leads to deteriorated toughness and grindability, unfavorably. Accordingly, the amount of (Fe+Ni+Mn) added is desirably 5.0 to 30.0% by weight.

Furthermore, if mechanical and physical characteristics are required to be improved, it is effective to add Si or Ti, Cr, V, Mo, Zr, and the like. In particular, the effect of adding Si will help the reduction in coefficient of thermal expansion, increase in rigidity, improvement in wear resistance, and the like, as described above. However, in the case of liquid-phase sintering, since Si crystals are coarsened and toughness is reduced, the amount of Si that can be added becomes less compared with the sintering method in which high densification is involved in molding. The present inventor has disclosed a method of producing Al—high Si alloy utilizing this semi-stable liquefying phenomenon in Japanese Patent Publication HEI 3-124846, in which case too much an amount of Si added would be a problem in applications that need material's toughness and reliability. Thus, in the present invention, in which the toughness can be retained and thermal expansion and wear resistance can be improved through addition of transition elements, the upper limit of Si addition is set to 8.0% by weight, which will not cause the toughness of to be deteriorated to a considerable extent. Also, since the ingredients of Ti, Cr, V, Mo, and Zr are expensive and moreover their addition amount over 8.0% by weight would cause reduction in toughness, the upper limit of the addition has been set to 8.0% by weight.

The present invention is not required to contain these elements.

Dispersion of hard particles

When mechanical and physical characteristics, in particular, need to be improved, it can be achieved by dispersing fine particles. Particles to be dispersed have only to be able to improve the coefficient of thermal expansion, rigidity, strength, wear resistance, and the like when made composite. The particles are desirably free from dispersion diffusion or condensation growth. Such particles to be selected for this purpose include intermetallic compounds, carbides, oxides, nitrides, borides, silicides, and the like. Examples are listed below.

(1) Intermetallic compounds: Transition metal aluminide, transition metal compounds (2) Carbides: Aluminum carbide, silicon carbide, titanium carbide, boron carbide, etc.

(3) Oxides: Alumina, silica, mullite, zinc oxide, yttria, etc.

(4) Nitrides: Alumina yttride, silicon nitride, titanium nitride, etc.

(5) Borides: Titanium boride, etc.

(6) Silicides: Molybdenum silicide, etc.

Particle size of dispersed particles

Size of particles is also an important factor. This differs depending on the primary intention.

(1) For enhancement in dispersion . . . 0.1 to 1 μm

Intended to stop the movement of transition by the dispersed matters. In this case, particles of fine particle size on the order of 0.1 to 1 μm are desirable.

(2) For compounding effect . . . 1 to 20 μm

Intended to ensure the degree of coupling at the matrix interfaces of composite particles, thereby enhancing the volume ratio.

(3) For improving wear resistance . . . 5 to 30 μm

Intended to disperse relatively coarse particles of 5 to 30 μm, thereby preventing the particles to fall off by sliding movement. These particles may be added singly or in combination in plural types.

Amount of dispersed particles

The amount of dispersed particles below 0.5% by volume would result in no exertion of the effect of adding the particles. Conversely, its amounts exceeding 30% by weight would cause deteriorated grindability and toughness. Accordingly, the amount of dispersed particles is desirably 0.5 to 30% by weight.

Means for adding dispersed particles

As the means for adding dispersed particles, a mixing method in which these dispersed particles are mixed to the material powder is economical and easy, exerting effects upon improvement in physical characteristic values. However, in a simple mixing method, dispersed particles will be present only at old powder grain boundaries with the result that the particles cannot be dispersed within the powder, in which case substantial characteristic improvement by dispersion of particles is difficult to accomplish. Also, when fine particles are dispersed, the method is improper because sintering couplings among powder particles are obstructed. To solve this problem, it is effective to disperse the particles within the powder particles. Two methods are available as the solution.

(1) Method in which molten metal containing dispersed particles is powdered in the process of manufacture of powder This method is to powder the molten metal to which particles have been added by rapid solidification. Since the particles are added before powdering, particles are dispersed in the interior of the powder. It is necessary to use an ingot which contains uniformly dispersed particles previously manufactured by dissolution casting or to add dispersed particles into molten metal and perform induction-dissolution with high agitation ability.

(2) Method in which mixed powder to which dispersed particles have been added is mechanically crushed and recoalesced This method is to add particles to rapidly solidified powder and subject them to mechanical crushing and recoalescence. This mechanical crushing and recoalescing processing allows the added particles to be finely and uniformly integrated into the aluminum alloy powder. It is also possible to generate and disperse carbides, oxides, or intermetallic compounds by mechanical crushing and recoalescing process during the processing.

This processing is carried out not by the wet process such as ball mill crushing and mixing but by the dry process. In some cases, a stearic acid or alcohol is added in a small amount as a PCA (Process Control Agent) to prevent excessive coalescence. As the processing system, an attritor is suitable for high-speed processing. On the other hand, the ball mill, although taking a long time processing, allows an easy control of atmosphere, capable of offering a good economy only if the throw-in energy is properly designed.

Processed powder obtained in this way is such that dispersed particles contained therein are finely crushed and dispersed uniformly in the powder. Thus, with the sintering of the powder, there can be produced aluminum-base-particles combined sintered alloys in which fine particles have been dispersed uniformly and without any segregation.

Sizing and coining

Sintered products, having pores in their interior, can be treated with sizing or coining, which allows a great improvement in surface roughness and dimensional accuracy. Thermally processed products may also be subjected to the processing of sizing and coining.

DETAILED DESCRIPTION OF THE PREFERRED EMBODIMENTS

<Example 1>

Two types of powders (1) and (2) manufactured by the air atomizing method as shown in Table 1 were prepared. Their max. particle size was below 300 μm and the mean particle size, 35 μm.

TABLE 1

| | Powder composition (wt %) | | | | | | |
|---|---|---|---|---|---|---|---|
| No. | Mg | Cu | Si | Mn | Fe | Ni | Al |
| (1) | 1.3 | 0.4 | 23.9 | 0.6 | 0.4 | Tr. | Bal. |
| (2) | 1.7 | 3.9 | 0.1 | 0.6 | 4.9 | 5.7 | Bal. |

These powders were annealing treated at 400° C. Thereafter, with an acetone solution of myristic acid applied to a metal mold, the powders were molded into 10×10×55 mm test pieces at a molding pressure of 7 ton/cm$^2$. The molded products were sintered for 4 hours at 540° C. in three types of normal-pressure atmospheres as specified below in which a nitrogen-combination accelerating component gas has been introduced to 0.005 atm.

(a) In a normal-pressure atmosphere with a 0.99 atm or more nitrogen partial pressure and a 0.005 atm or less steam partial pressure;

(b) In a normal-pressure atmosphere with a 0.99 atm or more argon partial pressure and a 0.005 atm or less steam partial pressure; and (c) In a normal-pressure atmosphere with a 0.90 atm or more nitrogen partial pressure and a 0.05 atm or less steam partial pressure.

The sintered products were solution treated at the same temperature as the sintering temperature, and thereafter subjected to aging at 170° C.

Table 2 lists the dimensional changes and characteristic values in sintering.

TABLE 2

| | | Dimensional changes and heat-treated product characteristics | | | | | |
|---|---|---|---|---|---|---|---|
| Powder composition | | | (1) | | | (2) | |
| Molded product relative density | % | 93.5 | 93.4 | 93.6 | 85.5 | 85.4 | 85.3 |
| Sintering atmosphere | | (a) | (b) | (c) | (a) | (b) | (c) |
| Dimensional change rate | % | −0.76 | −0.36 | +0.42 | −2.37 | −0.33 | +1.34 |
| Heat-treated Nitrogen | wt % | 0.74 | <0.01 | <0.01 | 1.43 | 0.01 | <0.01 |

TABLE 2-continued

| Powder composition | | | Dimensional changes and heat-treated product characteristics (1) | | | (2) | | |
|---|---|---|---|---|---|---|---|---|
| product characteristics | content Oxygen content | wt % | 0.31 | 0.27 | 0.76 | 0.34 | 0.32 | 1.57 |
| | Young's modulus | kg/mm$^2$ | 8510 | 7300 | 6890 | 8170 | 4880 | 4610 |
| | Hardness | $H_RB$ | 81.4 | 68.5 | 25.3 | 88.9 | 48.1 | 3.0 |
| | Flexural strength | kg/mm$^2$ | 50.9 | 45.2 | 25.0 | 55.5 | 18.5 | 10.6 |
| | Tensile strength | kg/mm$^2$ | 34.5 | 23.8 | 12.6 | 36.8 | 16.5 | 9.7 |

From Table 2, it is understood that sintered alloys having superior characteristics can be obtained by effecting the sintering under progress of combination with nitrogen in a nitrogen atmosphere in which the steam partial pressure is suppressed.

Figure 1A:
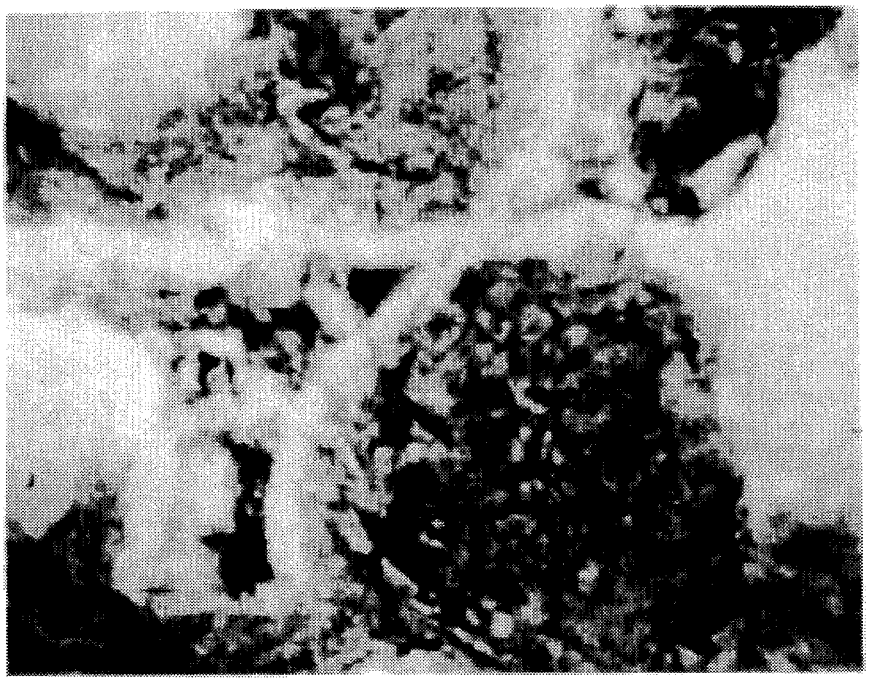
FIGS. 1A and 1B represent view of the structure of nitrogen compounds observable in the sintered products of powder compositions (1) and (2) according to Example 1 of the present invention through a scanning type electron microscope.
Figure 1B:
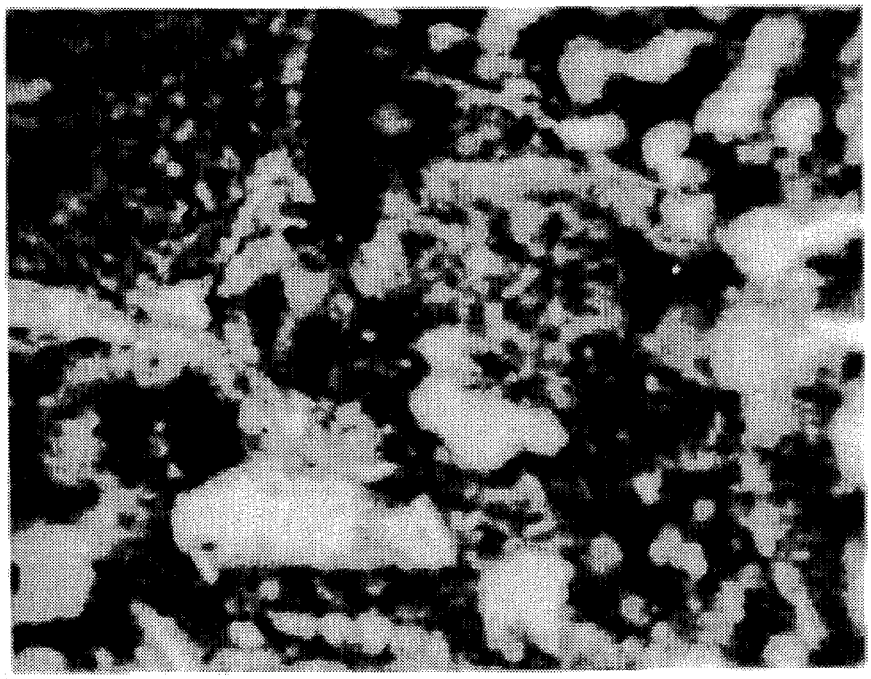

FIGS. 1A and 1B show the structure of nitrogen compounds observable in the sintered products of powder compositions (1) and (2) through a scanning type electron microscope.

<Example 2>

Two types of powders (1) and (2) manufactured by the air atomizing method as shown in Table 3 were prepared. Their max. particle size was below 300 μm and the mean particle size, 42 μm.

TABLE 3

| | Powder composition (wt %) | | | | | |
|---|---|---|---|---|---|---|
| No. | Mg | Cu | Si | Mn | Fe | Al |
| (1) | 0.04 | 0.27 | 25.6 | 0.17 | 0.48 | Bal. |
| (2) | 0.59 | 0.35 | 25.3 | 0.21 | 0.49 | Bal. |

Figure 2A:
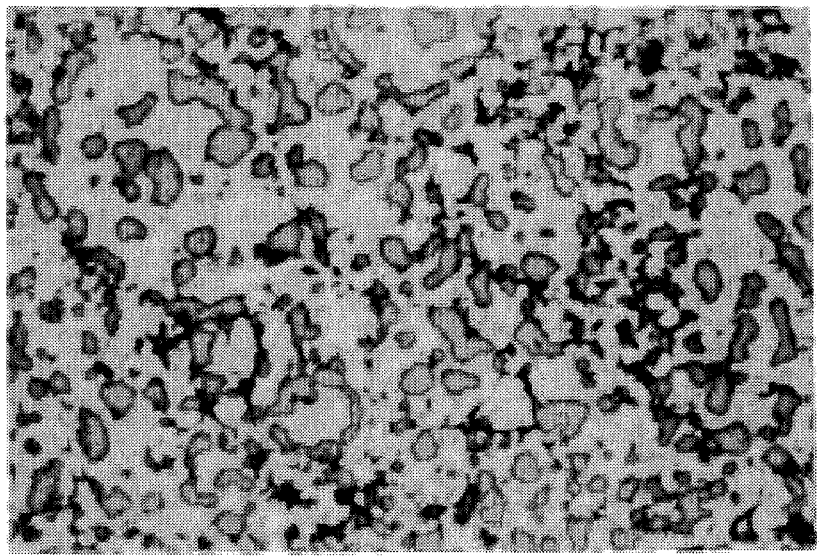
FIGS. 2A and 2B are views of the microstructures of sintered products of the powder compositions (1) and (2) according to Example 2 of the invention.
Figure 2B:
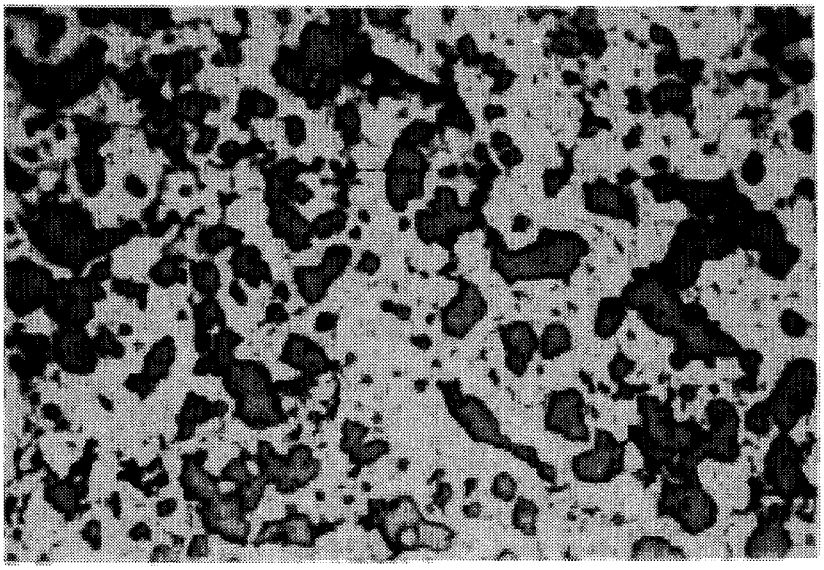
Figure 3A:
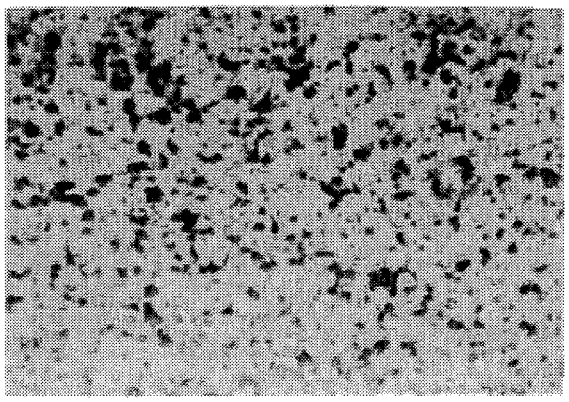
FIGS. 3A, 3B, 3C, and 3D are microstructures of the sintered products of the powder compositions (1), (2), and (3) and that of cast A390 alloy heat-treated product according to Example 3 of the invention.
Figure 3B:
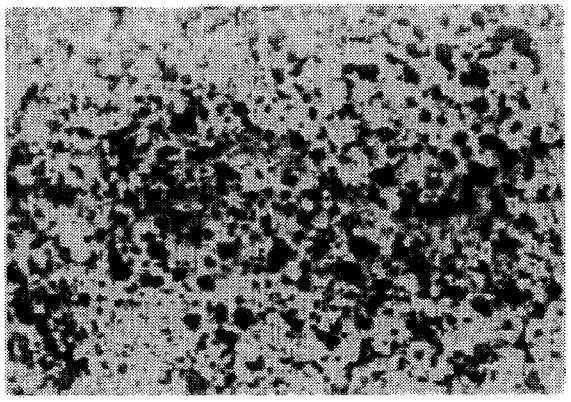
Figure 3C:
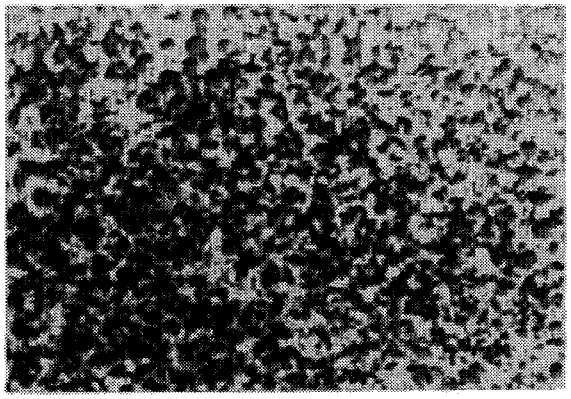
Figure 3D:
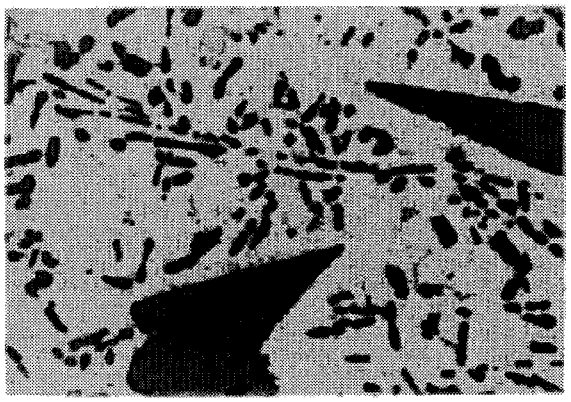
FIG.3D (PRIOR ART)
Figure 4A:
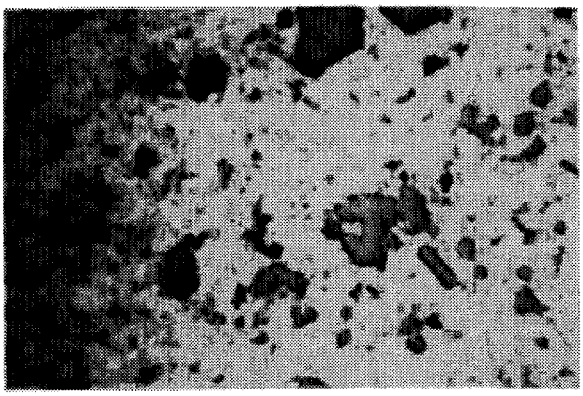
FIGS. 4A, 4B, 4C, and 4D are microstructures of sintered products of the powder compositions (1), (2), (3), and (4) according to Example 4 of the invention.
Figure 4B:
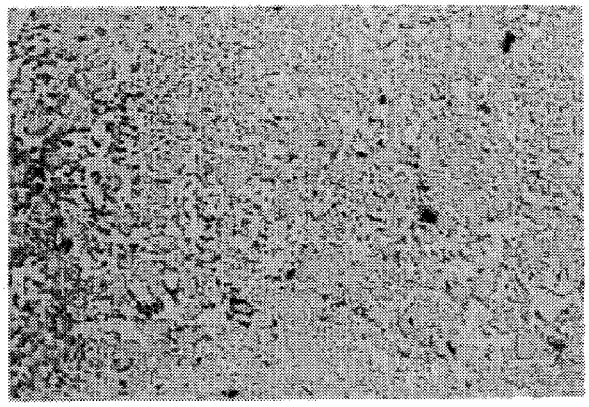
Figure 4C:
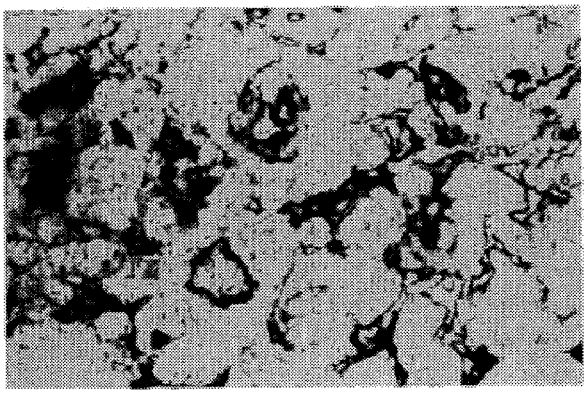
Figure 4D:
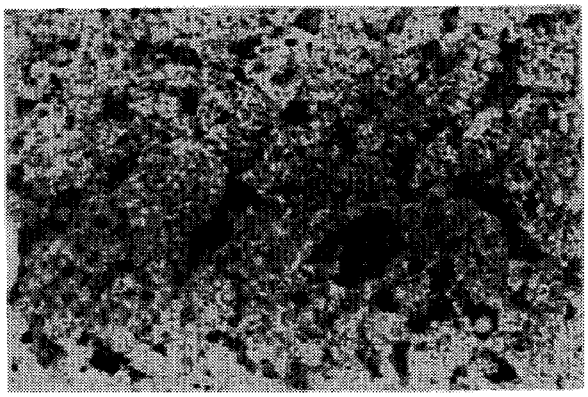

These powders were annealing treated at 300° C. Thereafter, with an acetone solution of myristic acid applied to a metal mold, the powders were molded into 10×10×55 mm test pieces so that the molded product relative density would fall in the range of 93.0 to 93.5% at a molding pressure of 7 ton/cm$^2$. The molded products were sintered for 0.5 to 4 hours at 560° C. in normal-pressure atmospheres with a 0.99 atm or more nitrogen partial pressure and a 0.003 atm or less steam partial pressure in which a reducing gas had been added to 0.004 atm. Table 4 lists the characteristic values of the sintered products. FIGS. 2A and 2B show the microstructure of the 4-hour sintered products.

and that the resulting sinterability was remarkably improved. Thus, it is understood that superior sintered product characteristics were obtained.

<Example 3>

Three types of Al-Si system alloy powders manufactured by the air atomizing method as listed below were prepared, their particle size being 5 to 149 μm.

(1) Al-9.0 Si-1.4 Mg-0.5 Cu-0.3 Mn-0.5 Fe alloy powder;

(2) Al-16.6 Si-1.5 Mg-0.5 Cu-0.4 Mn-0.6 Fe alloy powder; and (3) Al-24.8 Si-1.8 Mg-0.4 Cu-0.3 Mn-0.7 Fe alloy powder.

Figure 6:
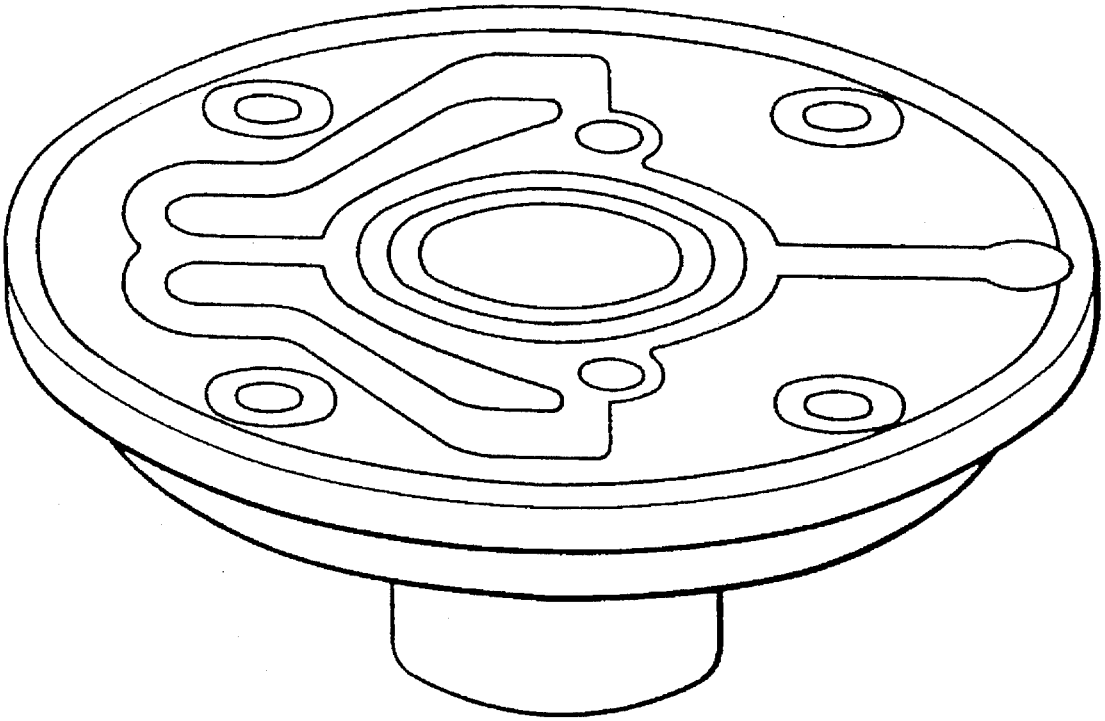
FIG. 6 is a perspective view showing the molded product shaped into a side plate according to Example 3 of the invention.

These powders were annealed at 400° C. Thereafter, with a powder lubricant added to 1 wt%, the mixed powders were granulated into sizes of 20 to 400 μm by a mechanical granulator. The granulated powders were molded into such a side plate shape as shown in FIG. 6 with a pressurizing area of 26 cm$^2$ by using a hydraulic 200 ton press so that the molding density would be 90 to 94%. The molded products were sintered in an oven into which a $N^2$ gas with a reducing gas added to 0.002 atm and its steam partial pressure being 0.003 atm or less had been flowed. The temperature inside the oven was 540° C., and the heating time in the oven was 2 hr. The sintered products were water cooled after sintering, and subjected to 170° C.×8 hr aging process. Table 5 lists the dimensional changes and characteristics in sintering. FIGS. 3A, 3B, 3C and 3D show photographs of the structure of the heat-treated products and that of the heat-treated material of cast A390 alloy. In addition, Al powder+Si powder+Mg powder were mixed to prepare a structure (3) equivalent mixed powder as a comparative material. The characteristics of the sintered product produced from the comparative material in the same production conditions and those of the case ADC12 material are also included in the table.

TABLE 4

| Powder composition | | | Dimensional changes and heat-treated product characteristics (1) | | | (2) | | |
|---|---|---|---|---|---|---|---|---|
| Sintering time | | Hr | 0.5 | 2 | 4 | 0.5 | 2 | 4 |
| Dimensional change rate | | % | −0.20 | −0.25 | −0.34 | −0.55 | −0.70 | −0.81 |
| Heat-treated product characteristics | Hardness | $H_RB$ | 31.3 | 36.9 | 46.2 | 66.1 | 70.0 | 74.0 |
| | Tensile strength | kg/mm$^2$ | 10.5 | 12.2 | 14.4 | 20.2 | 28.8 | 30.6 |

From Table 4, it can be observed that Si was diffused beyond old grain boundaries, exhibiting Ostwald growth,

TABLE 5

| Various characteristics of sintered products | | | | | | |
|---|---|---|---|---|---|---|
| | | Composition No. | | | | |
| | | (1) | (2) | (3) | | ADC12 |
| | | Production method | | | | |
| Item | | Invention sintering | | | Mixing-sintering | Casting |
| Dimensional change | % | −0.56 | −0.61 | −0.84 | +0.22 | — |
| Sintered product flatness | mm | 0.04 | 0.04 | 0.02 | 0.35 | — |
| Young's modulus | kg/mm$^2$ | 7410 | 7590 | 8100 | 5050 | 7040 |
| Coefficient of thermal expansion | $\times 10^{-6}$/K | 19.9 | 18.1 | 16.2 | 17.3 | 20.3 |
| Hardness | $H_RB$ | 71.1 | 73.4 | 79.6 | 14.7 | 67.1 |

From Table 5, it can be understood that according to the invention method products having complex shapes such as side plates can be produced with high accuracy and good economy from aluminum sintered alloys with low thermal expansion and superior characteristics.

<Example 4>

Four types of Al-Fe-Ni-Mn system alloy powders (1) to (4) manufactured by the air atomizing method as shown in Table 6 were prepared.

TABLE 6

| | Powder composition (wt %) | | | | | | | | | |
|---|---|---|---|---|---|---|---|---|---|---|
| No. | Mg | Cu | Mn | Fe | Ni | Si | Ti | Mo | Zr | Al |
| (1) | 1.8 | 3.4 | 6.6 | 3.2 | 3.8 | 7.2 | 0.1 | Tr. | Tr. | Bal. |
| (2) | 2.2 | 3.9 | 5.1 | 0.7 | 5.6 | 0.1 | Tr. | Tr. | Tr. | Bal. |
| (3) | 3.1 | 4.3 | 4.9 | 5.2 | 0.2 | Tr. | 0.2 | 0.2 | 0.2 | Bal. |
| (4) | 2.4 | 4.1 | 0.6 | 5.4 | 4.9 | Tr. | 0.2 | Tr. | Tr. | Bal. |

Next, the powders classified into less than 105 μm were annealed at 400° C. Thereafter, with a powder lubricant added to 1 wt%, the mixed powders were molded into 10×10×55 mm test pieces at a surface pressure of 6 to 8 ton/cm$^2$, thereby preparing molded products with the relative density of 82 to 88%. The molded products were sintered in a belt oven into which a $N_2$ gas with a reducing gas added to 0.002 atm and its steam partial pressure being 0.003 atm or less had been flowed. The temperature inside the oven was 540° C., and the heating time in the oven was 1 hr. The sintered products were water cooled after sintering, and subjected to 170° C.×8 hr aging process. Table 7 lists the characteristics of the sintered products. FIGS. 4A, 4B, 4C and 4D show microstructures of the sintered. When the sintered products was subjected to sizing, they showed improved max. surface roughness of 3 μm and dimensional accuracy of 10 μm. In addition, as comparative materials, from a composition (4) equivalent alloy were prepared a sintered alloy produced by using a powder having a slow solidification rate of 149 to 350 μm under the same conditions, a sintered alloy produced by using a mixed powder in which 4 wt% Cu powder and 2.5 wt% Mg powder have been added to Al-4.4 Ni-5.5 Fe-0.4 Mn powder under the same conditions, and a cast alloy produced by casting. The characteristics of their heat-treated products are also included in the table.

TABLE 7

| Characteristics of heat-treated products [*:impossible to measure] | | | | | | | | |
|---|---|---|---|---|---|---|---|---|
| Production method | | | Sintering method of <105 μm powder (present invention) | | | | Coarse powder sintering | Mixing | Casting |
| Powder composition | | | (1) | (2) | (3) | | (4) | | |
| Sintered product relative density | | % | 92.4 | 93.7 | 94.0 | 93.9 | 86.2 | 84.6 | — |
| Dimensional change rate | | % | −2.2 | −1.9 | −2.2 | −2.6 | −0.8 | −0.4 | — |
| Characteristics | Young's modulus | kg/mm$^2$ | 8400 | 7840 | 8120 | 7760 | 6400 | 4200 | * |
| | Hardness | $H_RB$ | 91.2 | 77.5 | 88.5 | 86.4 | 61.3 | 22.1 | * |
| | Tensile strength | kg/mm$^2$ | 36.6 | 36.6 | 37.2 | 35.4 | 23.6 | 8.1 | 5.5 |

By using a powder having a fast solidification rate, liquefication of the semi-stable phase accelerates the compaction, making it possible to produce alloys having superior characteristics which could not be produced by the casting method. No generation of liquid phase can be found even if the ground chips of the sintered products of the present invention. Thus, it is understood that the semistable phase has all transited to the stable phase.

<Example 5>

In a melting oven in which two types of base metals as shown in Table 8 had been melted, after 2.0% by volume of $Al_2O_3$ particles with a mean particle size of 4 μm and 10% by volume of SiC particles with a mean particle size of 9 μm were added, particle-dispersed composite powders with a mean particle size of 40 μm or so were produced by the air atomizing method.

TABLE 8

| | Molten metal composition (wt %) | | | | | | | |
|---|---|---|---|---|---|---|---|---|
| No. | Mg | Cu | Si | Mn | Fe | Ni | Ti | Al |
| (1) | 1.8 | 0.2 | 20.1 | 0.7 | 0.3 | 0.2 | 0.1 | Bal. |
| (2) | 2.1 | 3.7 | 0.1 | 0.6 | 4.5 | 5.6 | Tr. | Bal. |

These powders were annealed at 400° C. Thereafter, with an acetone solution of stearic acid applied to a metal mold, the powders were molded into 10×10×55 mm test pieces at a molding pressure of 7 to 8 ton/cm$^2$. The molded products were sintered for 2 hours at 500° C. in a normal-pressure atmosphere with a 0.99 atm or more nitrogen partial pressure and a 0.005 atm or less steam partial pressure in which a reducing gas had been added to 0.002 atm, and then subjected to heat treatment. Table 9 lists the characteristic values of the heat treated products.

TABLE 9

| | Dimensional changes and characteristics of heat treated products | | | |
|---|---|---|---|---|
| Powder composition | | | (1) | (2) |
| Molded product relative density | | % | 94.2 | 86.6 |
| Dimensional change rate | | % | −0.78 | −2.22 |
| Characteristics | Nitrogen content | wt % | 0.84 | 1.66 |
| | Young's modulus | kg/mm$^2$ | 9420 | 9180 |
| | Hardness | $H_RB$ | 83.7 | 91.9 |
| | Tensile strength | kg/mm$^2$ | 36.5 | 38.4 |

From Table 9, it is understood that physical and mechanical characteristics were improved by dispersion of the particles.

<Example 6>

Two types of powders (1) and (2) manufactured by the air atomizing method as shown in Table 10 were prepared. Their max. particle size was below 300 μm and the mean particle size, 35 μm.

TABLE 10

| | Powder composition (wt %) | | | | | | |
|---|---|---|---|---|---|---|---|
| No. | Mg | Cu | Si | Mn | Fe | Ni | Al |
| (1) | 1.3 | 0.4 | 23.9 | 0.6 | 0.4 | Tr. | Bal. |
| (2) | 2.2 | 3.9 | 0.1 | 5.1 | 0.7 | 5.6 | Bal. |

These powders were mixed with 2% by volume of yttria particles with a mean particle size of 1.2 μm, and thereafter subjected to mechanical crushing and recoalescing process by using a high-energy ball mill. After these powders were annealing treated at 420° C., with an acetone solution of stearic acid applied to a metal mold, the powders were molded into 30×40 mm tablets at a surface pressure of 11 ton/cm$^2$. The molded products were sintered for 4 hours at 540° C. in a normal-pressure atmosphere with a 0.99 atm or more nitrogen partial pressure and a 0.005 atm or less steam partial pressure in which a reducing gas had been added to 0.02 atm, and then subjected to heat treatment. The sintered products were subjected to a sizing process so as to be formed into tablets with a roundness of 10 μm. Table 11 lists the characteristic values of the heat-treated products.

TABLE 11

| | Dimensional changes and heat-treated product characteristics | | | |
|---|---|---|---|---|
| Powder composition | | | (1) | (2) |
| Molded product relative | | % | 95.6 | 89.2 |
| Dimensional change rate | | % | −0.78 | −1.77 |
| Characteristics | Nitrogen content | % | 0.65 | 1.11 |
| | Young's modulus | kg/mm$^2$ | 8920 | 8780 |
| | Hardness | $H_RB$ | 88.2 | 93.4 |
| | Tensile strength | kg/mm$^2$ | 36.5 | 38.4 |

From Table 11, it is understood that the physical and mechanical characteristics were improved by dispersion of the particles.

<Example 7>

Two types of powders (1) and (2) manufactured by the air atomizing method as shown in Table 12 were prepared. Their max. particle size was below 300 μm and the mean particle size, 35 μm.

TABLE 12

| | Powder composition (wt %) | | | | | | |
|---|---|---|---|---|---|---|---|
| No. | Mg | Cu | Si | Mn | Fe | Ni | Al |
| (1) | 1.3 | 0.4 | 23.9 | 0.6 | 0.4 | Tr. | Bal. |
| (2) | 1.7 | 3.9 | 0.1 | 0.6 | 4.9 | 5.7 | Bal. |

These powders were annealed at 350° C. Thereafter, 10 and 20 wt% of 2024 (Al-4.1 Cu-1.4 Mg-0.4 Mn-0.3 Si) alloy powders were mixed and further 1 wt% of powder lubricant was added thereto, followed by blending with a V blender. The mixed powders were molded into 10×10×55 mm test pieces at a surface pressure of 7 ton/cm$^2$. The sintered products were sintered for 2 hours at 550° C. in a normal-pressure atmosphere with a 0.99 atm or more nitrogen partial pressure and a 0.005 atm or less steam partial pressure in which a reducing gas had been added to 0.04 atm, and then subjected to heat treatment. Table 13 lists the characteristic values of the heat-treated products.

Figure 5A:
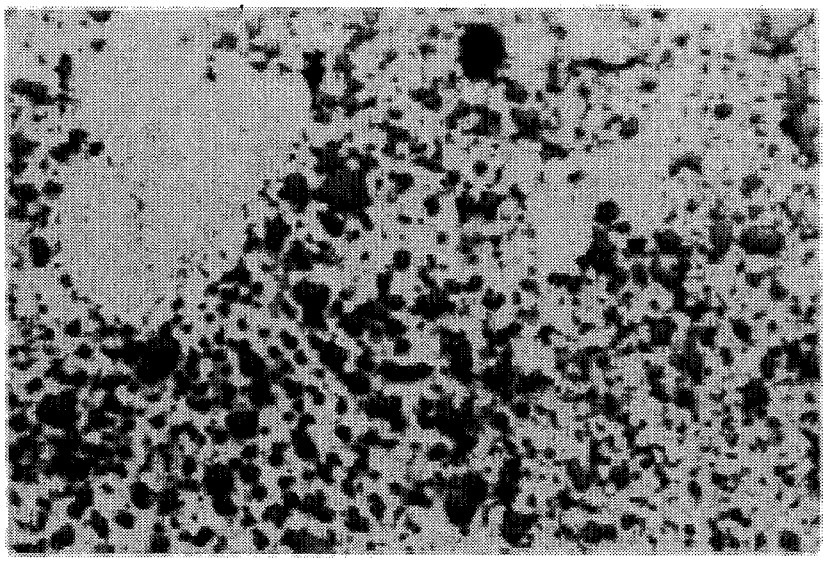
FIGS. 5A and 5B are microstructures of the sintered products of the powder compositions (1) and (2) according to Example 7 of the invention.
Figure 5B:
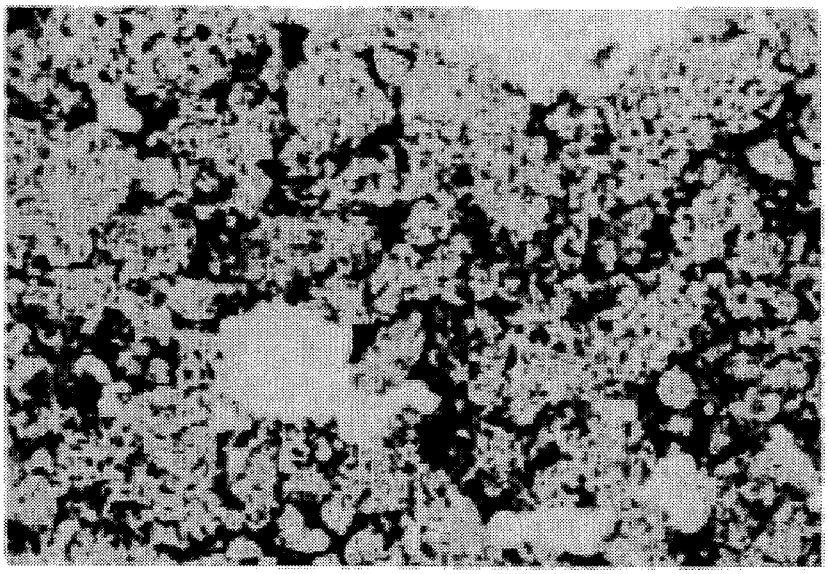

FIGS. 5A and 5B show photographs of the structure of the heat-treated product in which 10 wt% of 2020 powder was mixed to powder (1) sintered at 540° C. and that of the heat-treated product in which 10 wt% of 2024 powder was mixed to powder (2).

TABLE 13

| Tensile strength | | | |
|---|---|---|---|
| | Mixing content of 2024 powder (wt %) | | |
| Powder composition | 0 | 10 | 20 |
| (1) | 35.7 | 38.8 | 40.2 |
| (2) | 37.0 | 39.1 | 42.5 |

From Table 13, it is understood that mechanical characteristics were improved by mixing and addition of soft particles.

<Example 8>

By using the powders evaluated in Example 2, sintered materials and powder forged materials were prepared. The conditions for producing sintered materials were similar to those in Example 2, except that the sintering time was 4 hr.

Tests were conducted by a thrust type friction tester which works in such a way that a ring-shaped test piece and a plate test piece are slid in a wet process. The plate member was implemented by a heat-treated A390 (Al-17 Si alloy). The sliding area was 1.2 $cm^2$, and the sliding speed was 4 m/sec constant. The load was the step-up type, in which it is increased in steps of 5 kgf for every one minute, up to 500 kgf. If the seizure occurs before the tester reaches the last load, the tester stops, where the load was regarded as a seizure load. Table 14 lists the test results, showing that the invention sintered materials have Si crystals or coin deposits of appropriate form effective to wear resistance uniformly dispersed, exhibiting superior wear resistance characteristic, compared with the powder forged materials. In particular, sintered product (2) exhibited a matrix structure exceeding Hmv 200, superior in wear resistance.

TABLE 14

| Seizure evaluation test results | | | | |
|---|---|---|---|---|
| | Ring material | | | |
| | Composition No. | Approximate composition | Seizure load Plate material | kgf |
| Invention | (1) | Al-25Si-1Mg | A390(T6) material | 425 |
| material | (2) | Al-5Ni-5Fe-4Cu-2Mg | " | >500 |
| Powder forged | (3) | Al-25Si-1Mg | " | 240 |
| material | (4) | Al-5Ni-5Fe-4Cu-2Mg | " | 305 |
| Cast material | (5) | Al-17Si-1Cu-1Mg-1Ni | " | 170 |

<Example 9>

An Al-5.5 Mn-3.4 Ni-1.4 Fe-3.7 Cu-2.2 Mg alloy powder manufactured by the air atomizing method was prepared. Its max. particle size was 105 μm or less and the mean particle size, 38 μm.

This powder was annealed at 400° C. Thereafter, with 0.7 wt% of a powder lubricant mixed thereto, the powder was molded into 40×16×5 mm test pieces at a molding pressure of 7 ton/$cm^2$. In molding, the powder was sintered for 2 hours at 540° C. in a normal-pressure atmosphere with a 0.99 atm or more nitrogen partial pressure and a 0.04 atm or less steam partial pressure in which a reducing gas had been added to 0.003 atm, followed by heat treatment. The heat-treated products were ground by both surfaces after grinding process, and then processed into 38.8×15.6×4.4 mm sliding vanes for use in rotary compressors.

Further, an Al-16.6 Si-1.5 Mg-0.5 Cu-0.3 Mn-0.6 Fe alloy powder manufactured by the air atomizing method was prepared. Its max. particle size was 149 μm or less and the mean particle size, 42 μm.

This powder was annealed at 400° C. Thereafter, with 1 wt% of powder lubricant mixed thereto, the powder was molded into a 59.5 mm-in-diameter rotor shape with 3.8 mm wide four grooves, under a molding pressure of 6 ton/$cm^2$. The molding was carried out by sintering the powder for 4 hours at 540° C. in the same normal-pressure atmosphere as with the vane materials, followed by heat treatment. The heat-treated products were processed into compressor rotors by grinding the vane grooves after turning their end faces.

Next, when the invention rotor and invention vane were operated in combination for 300 hr at the number of revolutions of 4800 rpm, both the rotor material and the vane material showed an wear amount of 5 μm or less, which is a practically applicable level. Also, compared with iron-based compressor of the same design, vibrations and noise were reduced 20% or more, with 8% increased efficiency.

Moreover, when a compressor was operated at the same number of revolutions with the vane material Ni-P plated, it showed no efficiency reduction even after 1000 hr operation.

According to the present invention, there are provided aluminum sintered alloys with high accuracy and high density which are excellent in mechanical and physical characteristics as well as superior in wear resistance, and which can be produced by atmospheric sintering methods that allows a high degree of freedom of shaping without plastic working. The sintered products by the present invention lend themselves to a variety of applications to various types of mechanical parts and sliding parts, for example, compressor parts such as side plates, housings, cylinders, casings, vanes, shoes, and rotors, automobile parts such as timing pulleys, oil pump rotors, and bushings, and business machine components such as rollers, gears, and bearings.

What is claimed is:

1. A method of producing nitrogen-combined aluminum sintered alloys, which comprises compression-molding a rapidly solidified aluminum alloy powder resulting from solidifying aluminum alloy molten metal containing 0.4 to 4.0% by weight of Mg at a solidification rate of $10^{2°}$ C./sec or more after annealing in the temperature range of 250 to 450° C. if necessary; sintering the molded products by generating nitrogen compounds on the powder surface at atmospheric pressure with a 0.8 atm or more nitrogen partial pressure and a 0.01 atm or less steam partial pressure in which a reducing gas component has been added to 0.01 atm or more as a nitrogen combination accelerating gas component.

2. A method of producing aluminum sintered alloys with high dimensional accuracy as claimed in claim 1, wherein the particle size of the atomized powder is 350 μ or less in its maximum particle size and 75 μm or less in its mean particle size.

3. A method of producing aluminum sintered alloys with high dimensional accuracy as claimed in claim 1, wherein the atomized powder is subjected to mechanical granulation treatment.

4. A method of producing aluminum sintered alloys with high dimensional accuracy as claimed in any of claims 1, wherein the molded product's relative density is 90% or more, the sintered material is sintered into the sintered product's relative density from 90% to 99% in the temperature range of 500 to 570° C., the dimensional change rate in sintering is within 1.5%, and the tensile strength of the sintered product is 25 $kg/mm^2$ or more.

5. A method of producing aluminum sintered alloys as claimed in any of claim 1, wherein the molded product's relative density is 70% or more, the sintered material is sintered into the sintered product's relative density of 90% to 99% in the temperature range from a liquid-phase generation temperature of a semi-stable phase generated by rapid solidification of the powder to the melting point of the powder, and the tensile strength of the sintered product is 30 $kg/mm^2$ or more.

6. A method of producing aluminum sintered alloys with high dimensional accuracy which are excellent in wear resistance and has a low thermal expansion coefficient as claimed in claim 4, wherein the aluminum alloy molten metal contains 4.0 to 40.0% by weight of Si and, as required, one or more components selected from Cu, Mn, Fe, and Ni within 2% by weight in total, the rest having a composition composed substantially of aluminum.

7. A method of producing aluminum sintered alloys which are excellent in wear resistance and has a low thermal expansion coefficient as claimed in claim 5, wherein the aluminum alloy molten metal contains 1.0 to 8.0% by weight of Cu as well as totally 5.0 to 30.0% by weight of one or more component selected from Fe, Ni, and Mn and, as required, further contains 8% by weight or less of one ore more component selected from Si, Ti, Cr, V, Mo, and Zr, the rest of the molten metal having a composition substantially composed of aluminum.

8. A method of producing aluminum sintered alloys which are superior in wear resistance and has a low thermal expansion coefficient as claimed in any of claims 1 to 7, wherein the aluminum alloy molten metal has 0.5 to 30% by volume of particles of at least one type selected from an intermetallic compound, carbide, oxide, nitride, boride, and silicide added therein.

9. A method of producing aluminum sintered alloys as claimed in any of claims 1 to 3, further comprising between the process of producing powder by rapid solidification and the process of compression molding the steps of: adding and mixing 0.5 to 30% by volume of particles of at least one type selected from an intermetallic compound, carbide, oxide, nitride, boride, and silicide, to the aluminum alloy powder; and, as required, integrating the mixture finely and uniformly into the aluminum alloy powder particles by a mechanical crushing and recoalescing process.

10. A method of producing aluminum sintered alloys as claimed in any of claims 1 to 3, the method further comprising before the molding process a step of: adding and mixing 30% by weight or less of an aluminum alloy powder which contains 0.4 to 4.0% by weight of Mg with a hardness lower than that of the following aluminum alloy powder and which has a composition substantially composed of 85% by weight or more of aluminum.

* * * * *